US006199350B1

(12) United States Patent
Brechel et al.

(10) Patent No.: US 6,199,350 B1
(45) Date of Patent: Mar. 13, 2001

(54) EVACUATION AND CLOSURE DEVICE IN LINEAR CONSTRUCTION

(75) Inventors: Karl Brechel, Langenburg; Dieter Klingler, Satteldorf, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/063,774

(22) Filed: Apr. 22, 1998

(30) Foreign Application Priority Data

Apr. 22, 1997 (DE) ..... 197 16 846

(51) Int. Cl.[7] ..... B65B 31/00; B65B 7/28

(52) U.S. Cl. ..... 53/510; 53/109; 53/264; 53/308

(58) Field of Search ..... 53/88, 109, 510, 53/167, 306, 308, 329, 264

(56) References Cited

U.S. PATENT DOCUMENTS

| | | | | |
|---|---|---|---|---|
| 3,255,568 | | 6/1966 | Martin et al. | 53/510 |
| 3,350,839 | * | 11/1967 | Carter | 53/88 |
| 3,855,749 | * | 12/1974 | McMickle, Jr. | 53/306 |
| 3,964,240 | * | 6/1976 | Evrard | 53/306 |
| 4,186,542 | * | 2/1980 | Oyagi | 53/88 |
| 4,409,775 | * | 10/1983 | Brody et al. | 53/510 |
| 4,602,473 | * | 7/1986 | Hayashi et al. | 53/510 |
| 4,658,566 | * | 4/1987 | Sanfilippo | 53/510 |
| 4,848,419 | * | 7/1989 | Damen | 53/109 |
| 5,048,259 | * | 9/1991 | Cox et al. | 53/329 |
| 5,129,213 | | 7/1992 | Hatakeyama | 53/510 |
| 5,406,772 | * | 4/1995 | Dinius | 53/167 |
| 5,438,814 | | 8/1995 | Lovett et al. | 53/505 |
| 5,720,148 | * | 2/1998 | Bedin et al. | 53/167 |
| 5,996,308 | * | 12/1999 | Nakamura | 53/167 |

FOREIGN PATENT DOCUMENTS

| | | |
|---|---|---|
| 3107627 | 1/1982 | (DE) . |
| 3626734 | 2/1988 | (DE) . |
| 0745555 | 12/1996 | (EP) . |
| 2280428 | 2/1995 | (GB) . |

* cited by examiner

*Primary Examiner*—Brian L. Johnson
*Assistant Examiner*—Matthew Luby
(74) *Attorney, Agent, or Firm*—Ronald E. Greigg; Edwin E. Greigg

(57) ABSTRACT

An evacuation and closure device in linear construction can be docked to a conveyor device for bottles. A closure stopper supply device is used to supply closure stoppers for the bottles. The device provides a combined closure stopper and evacuation unit for each bottle. The closure stopper and evacuation units are combined into a closure stopper and evacuation module. The closure stopper and evacuation module is fastened to one of three carriers that can be moved in three movement axes (X, Y, Z) in relation to one another. The movement is carried out by means of freely programmable drive mechanisms. Because of its construction, the evacuation and closure device according to the invention can be simply and flexibly adapted to various types of filling machines.

10 Claims, 4 Drawing Sheets

EVACUATION AND CLOSURE DEVICE IN LINEAR CONSTRUCTION

BACKGROUND OF THE INVENTION

The invention relates to an evacuation and closure device in linear construction. Devices of this kind are used in the pharmaceutical industry for small containers, e.g. vials, injection bottles, or infusion bottles. The known devices, embodied as so-called rotary machines as well as those embodied in linear construction, are disposed above a conveyor section for the small containers and, due to the predetermined number of spaces and the fact that its course of motion is always the same, is bound to a rigid, inflexible machine concept. Furthermore, in the known devices, for the cleaning or sterilizing of the apparatus by means of a sterilizing apparatus, for example when there is a new product charge or at the beginning of a new work shift, in order for the cleaning or sterilizing apparatus to be used in the known devices, interventions or modifications are required. Furthermore, as rotary machines and in linear construction, the known apparatuses are custom adapted to the preceding filling machines, i.e. only with great expense can the known apparatuses be used for other filling machines, which operate continuously, for example, instead of cyclically.

OBJECT AND SUMMARY OF THE INVENTION

The evacuation and closure device in linear construction according to the invention has the advantage over the prior art that the cleaning and sterilization can take place without additional manual interventions or modifications and that the device can at the same time be simply adapted to a wide variety of filling machines. This object is attained according to the invention by virtue of the fact that a number of evacuation and closure units are combined into a module and that the module can move in three movement axes that are perpendicular to one another. As a result, on the one hand, a virtually arbitrarily large number of required evacuation and closure units can be combined in accordance with the output of a filling machine and due to the mobility of the module, can be used in both continuously operating and cyclically operating filling machines. Because of the mobility, it is simultaneously possible to move the module out of the region of a conveyor section for the small containers so that at the conveying device that transports the small containers, no interventions or modifications are required for the cleaning or sterilizing since the module can be supplied as a whole to a separately disposed cleaning or sterilizing device. In addition, the integration of the closure and evacuation function into one evacuation and closure unit makes a particularly compact construction possible.

Advantageous improvements and updates of the evacuation and closure device in linear construction according to the invention arise from the disclosure set forth hereinafter.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
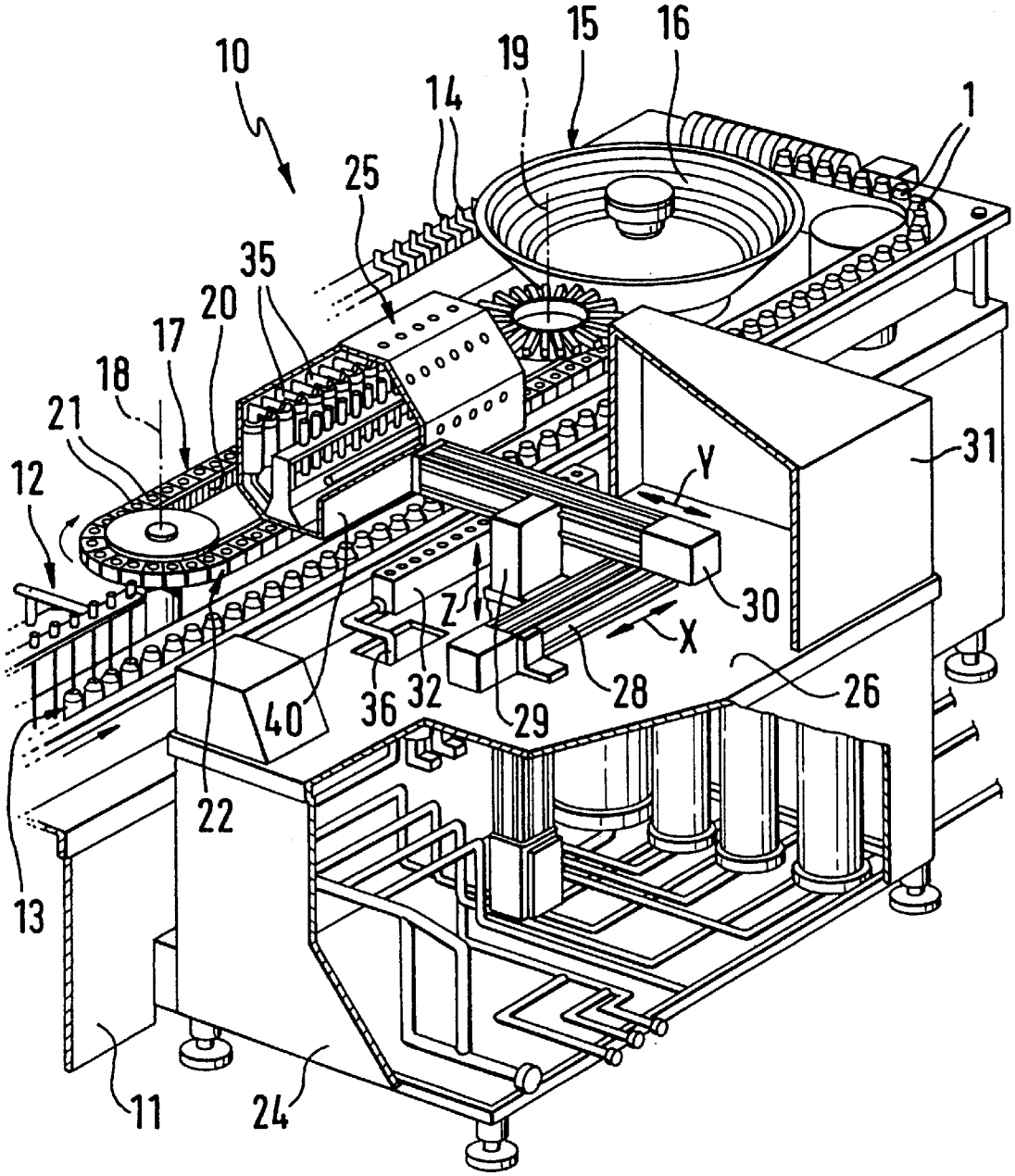
FIG. 1 shows a perspective view of an evacuation and closure device in linear construction in a partially sectional representation.
Figure 2:
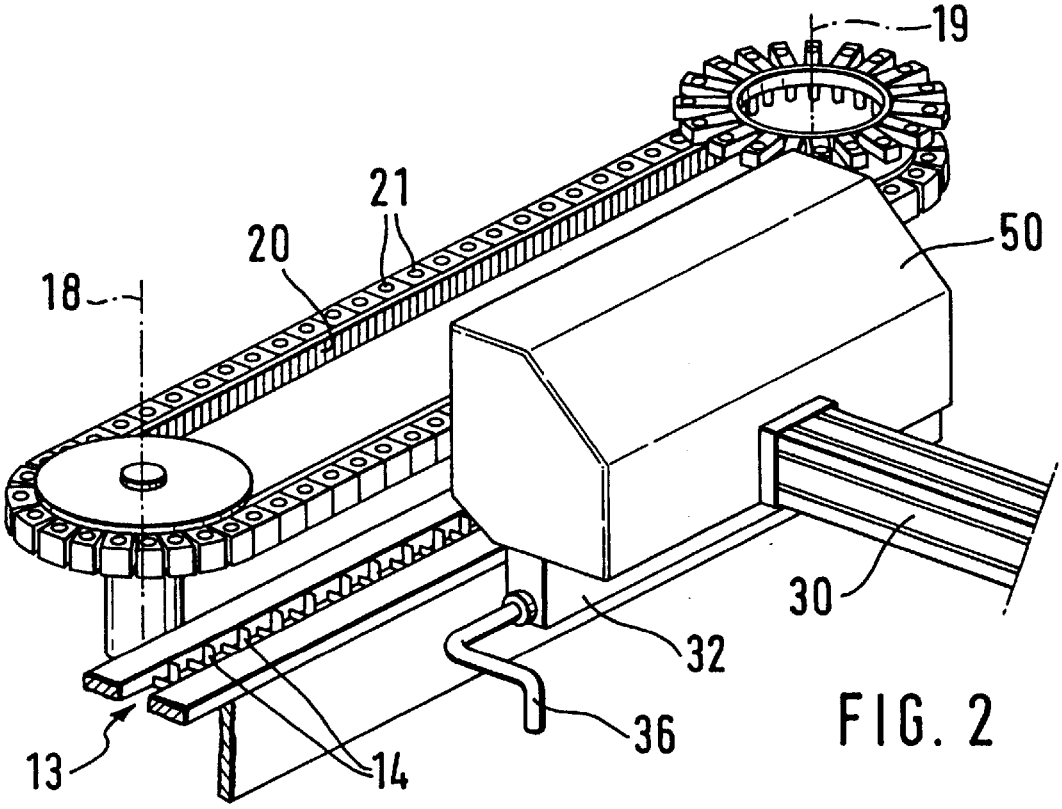
FIG. 2 shows a perspective view of a part of the device according to FIG. 1 during the sterilization process.
Figure 3:
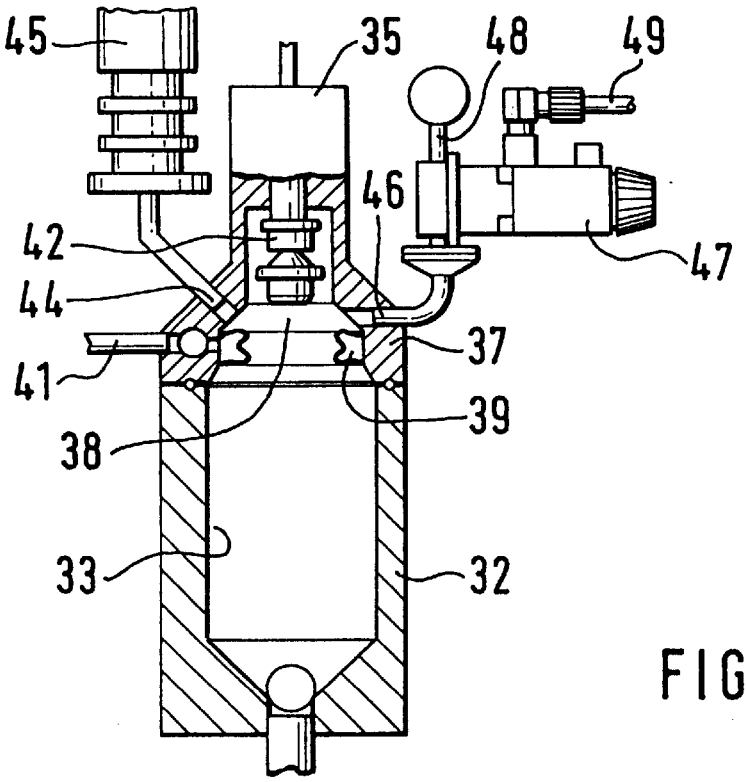
FIG. 3 shows a cross section through a part of the device according to FIG. 2.

The evacuation and closure device shown in FIG. 1, referred to below as the device 10, is used to evacuate and if need be, to gas a small container that is filled with pharmaceuticals to begin with, such as a vial, bottle 1, or the like, and to close the bottle 1 with a closure stopper 2 comprised of rubber, for example. To that end, the device 10 can be docked to a frame 11 of a filling machine, not shown in detail, i.e. for the frame 11, no particular arrangements or modifications are required with regard to the device 10. The device 10 adjoins the filling region 12 of the filling machine along a conveyor section that is embodied as straight, upon which the bottles 1 are continuously or cyclically conveyed by means of a conveyor device 13, for example a conveyor belt with lateral guides and catches 14 for maintaining a definite dividing space between the bottles 1.

Figure 4:
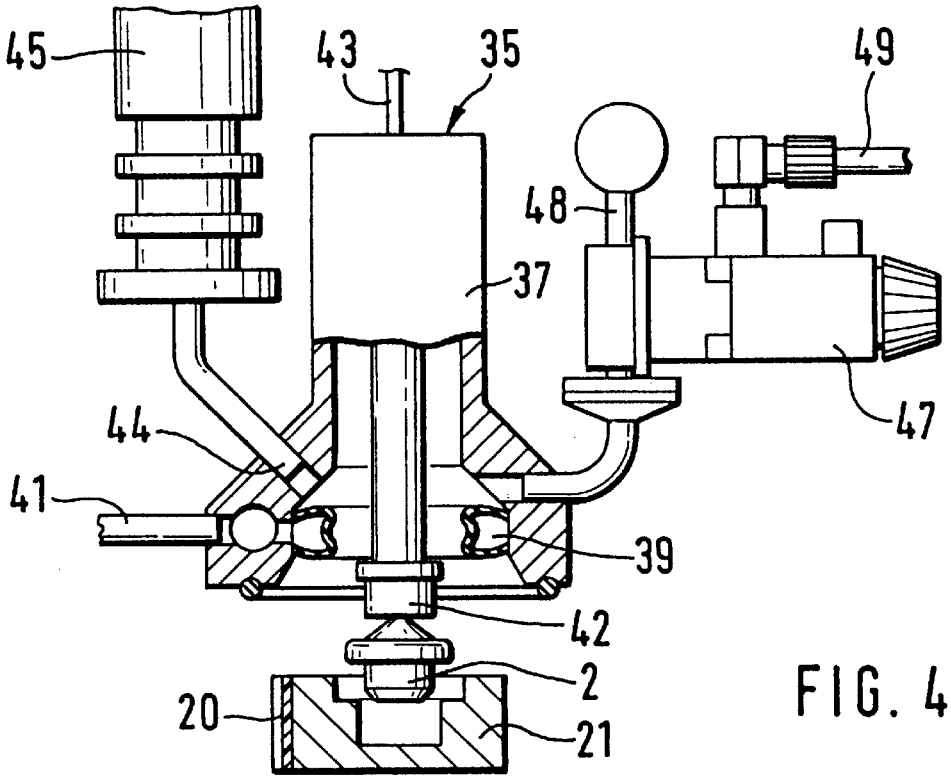
FIG. 4 shows a cross section of an evacuation and closure device during receiving a stopper.
Figure 5:
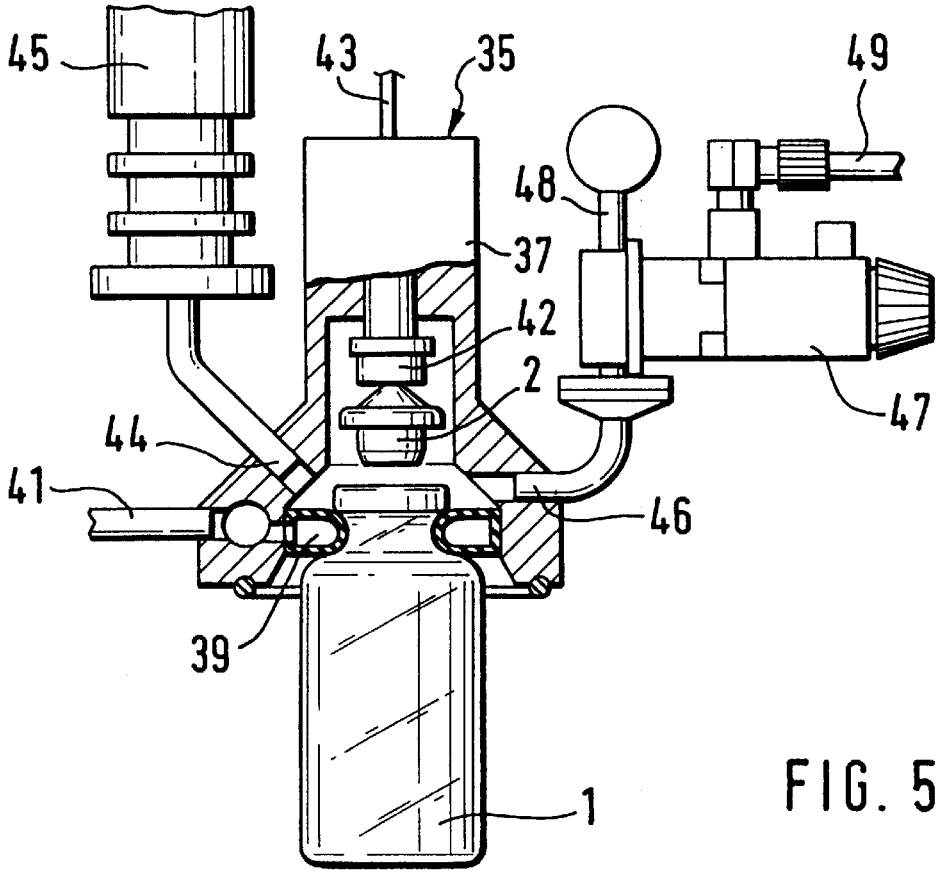
FIG. 5 shows the evacuation and closure module according to FIG. 4 during the evacuation of a small container.

A closure stopper supply device 15 is disposed on the opposite side of the conveyor device 13 from the device 10. The closure stopper supply device 15 has an intrinsically known conveying and sorting cup 16 for the closure stoppers 2, which sorts the closure stoppers 2 into a closure stopper belt 17. The closure stopper belt 17, which is supported on two horizontally disposed rotating axles 18, 19 and is continuously or cyclically driven, has a carrier belt 20 wound around the rotating axles 18, 19 and a closure stopper receptacle 21 for each closure stopper 2 is attached to this carrier belt (FIG. 4). The closure stopper belt 17 is arranged in such a way that the closure stoppers 2 are transported parallel to and in the same feed direction as the bottles 1 along a straight conveyor section 22 which extends at the level of the bottle mouths.

The device 10, which essentially has a box-shaped machine frame 24, has an evacuation and stopper insertion module 25 that can move along three movement axes X, Y, Z disposed perpendicular to one another. To realize the movement of the evacuation and stopper insertion module 25, a first carrier rail 28 is fastened to the top side 26 of the machine frame 24, extending parallel to and beneath the conveyor section 22, and a second carrier rail 29 is supported so that it is disposed perpendicularly on the side oriented toward the first conveyor device 13. The second carrier rail 29, which protrudes partially through a recess embodied in the top side 26 of the machine frame 24, can be moved along the first carrier rail 28 in the direction of the movement axis X and at the same time, can be moved vertically along the movement axis Z. A third carrier rail 30 is disposed at the head region of the second carrier rail 29, and can be moved along the movement axis Y. The evacuation and stopper insertion module 25 is in turn fastened to the end of the third carrier rail 30 oriented toward the conveyor device 13.

The movements of the three carrier rails 28, 29, 30 are carried out by means of three drive mechanisms, not shown, which are independent of each other and are controlled by the control unit of the device 10 in such a way that arbitrary movements of the evacuation and stopper insertion module 25 with regard to the movement axes X, Y, Z can be permitted. The three carrier rails 28, 29, 30 consequently have the function of three freely programmable linear axes. Furthermore, a protective cap 31 is fastened to the machine frame 24 and covers the three carrier rails 28, 29, 30, wherein an opening is embodied on the end face of the protective cap 31 oriented toward the conveyor device 13 and the third carrier rail 30 protrudes through this opening.

A strip-shaped sterilization plate 32 for cleaning or sterilizing the evacuation and stopper insertion module 25 is disposed on the top side 26 of the machine frame 24, inside the protective cap 31. At the same time, recesses 33 for evacuation and stopper insertion units 35 are provided on the top side of the end plate 32. A discharge for a cleaning agent is embodied on a side face of the washing plate 32 and is connected to a discharge line 36. The function of the washing plate 32 will be discussed in further detail at a later time below.

The evacuation and stopper insertion module 25 has a carrier plate 40 to which the identical evacuation and stopper insertion units 35 can be fastened, in the exemplary embodiment, there are twelve evacuation and stopper insertion units 35. The evacuation and stopper insertion units 35 are arranged or spaced apart from one another in such a way that they can be disposed coinciding with the bottles 1 being conveyed in the conveyor device 13. The number of evacuation and stopper insertion units 35 is a function of the output of the filling machine and the desired residual oxygen content in the bottles 1, which should be 0.5%, for example. Each evacuation and stopper insertion unit 35 has a sleeve-shaped housing 37 with a receiving opening 38 oriented toward the bottle 1. On the inside of the housing 37, a rotating, pneumatically driven bottleneck seal 39 is disposed in the region of the receiving opening 38 that acts as a vacuum chamber and this seal is connected to an overpressure source that is not shown via a line 41. Furthermore, a vacuum plunger 42 that moves up and down is guided in the housing 37 and has a centrally embodied longitudinal bore for the purpose of receiving and holding a closure stopper 2 and this longitudinal bore is connected via a first vacuum line 43 to a controllable vacuum source that is not shown. For controlling the vacuum that prevails in the housing 37 when the bottle 1 is being evacuated, a pressure absorbing connection 44 is embodied in the wall of the housing 37 and a pressure absorber 45 that is disposed laterally on the housing 37 is inserted into this connection. The pressure absorber 45 is connected to the control unit of the device 10. To generate the vacuum measured by the pressure absorber 45, a vacuum connection 46 is also embodied in the wall of the housing 37 and is connected to the vacuum source via a membrane valve 47 and another vacuum line 48. Furthermore, the membrane valve 47 is fed by a supply line 49 for the control air, which is for opening or closing the membrane valve 47. The evacuation and stopper insertion units 35 mounted on the carrier plate 40 are encompassed by a common casing 50.

It is furthermore emphasized that an additional connection for the supply of a protective gas can be provided in the wall of the housing 37 so that the gassing of the head region of the bottle 1 is made possible by means of intrinsically known devices.

The above described device 10 functions as follows: The closure stoppers 2 are sorted from the conveying and sorting cup 16 into the closure stopper receptacles 21 of the cyclically or continuously revolving closure stopper belt 17. For the removal of the closure stoppers 2 from the closure stopper receptacles 21 by means of the evacuation and stopper insertion units 35, the evacuation and stopper insertion module 25 is brought above the conveyor section 22, to coincide with the closure stoppers 2. Then the evacuation and stopper insertion units 35 are lowered to just above the closure stopper receptacles 21 and the vacuum plungers 42, for example actuated pneumatically, are moved out of the housings 37 until they are operatively connected to the closure stoppers 2. Then, the vacuum in the vacuum plungers 42 is switched on and through the returning or lifting of the vacuum plungers 42 (FIG. 4), the closure stoppers 2 are inserted into the receiving openings 38 that function as vacuum chambers. In the course of this, the suction force between the vacuum plungers 42 and the closure stoppers 2 is used to hold the closure stoppers 2 mechanically fixed in the upper position.

It is essential that the movements of the evacuation and stopper insertion module 25 are adapted to the movements or the conveying speed of the closure stoppers 2 in the closure stopper belt 17. This adaptation is carried out by means of the control unit of the device 10, which correspondingly controls the drive mechanisms of the carrier rails 28, 29, 30.

After this, by means of the above-mentioned drive mechanisms for the carrier rails 28, 29, 30, the evacuation and stopper insertion module 25 is brought above the bottles 1 that are cyclically or continuously conveyed, and is lowered onto them until the neck regions of the bottles 1 have dipped into the receiving openings 38 of the evacuation and stopper insertion units 35. Here too, the synchronization of the movements of the evacuation and stopper insertion module 25 with the conveying of the bottles 1 is in turn carried out by means of the three drive mechanisms for the carrier rails 28, 29, 30, which drive mechanisms can be independently controlled by the control unit of the device 10. After the neck regions of the bottles 1 have dipped into the receiving openings 38, the bottleneck seals 39 are activated by means of overpressure so that evacuation chambers that are sealed in relation to the outside are embodied in the housings 37 above the neck regions of the bottles 1. To evacuate the head regions of the bottles 1 above their fill level, then the air is sucked out of the housings 37 above the bottles 1 by means of the membrane valve 47 via the vacuum line 48, and then if need be, protective gas is introduced into the head regions of the bottles 1 via an additional protective gas supply device that is not shown in the drawing.

The evacuation of the bottles 1 can take place in a number of pressure stages, wherein the respectively attained vacuum is detected by means of the pressure absorber 45 and is supplied as an input value to the control unit of the device 10. If a particular required vacuum is not achieved, for example due to a leak in a bottleneck seal 39, then the bottle 1 in which this occurs can subsequently be discharged by means of a rejecting device, not shown.

Figure 6:
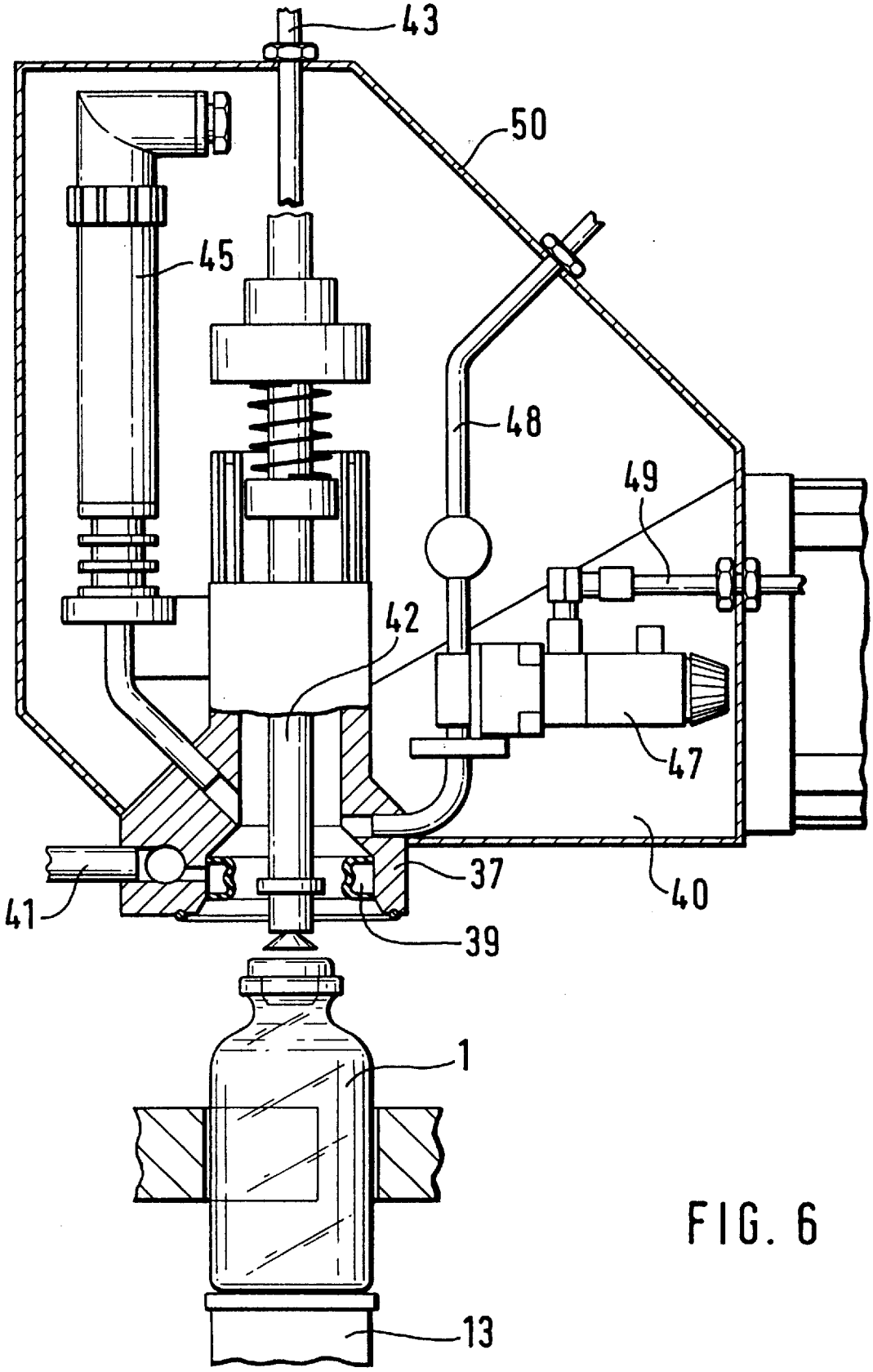
FIG. 6 shows the evacuation and closure module according to FIG. 4 while a closure is being pressed into a small container.

As soon as the evacuation and if need be the gassing with the protective gas has been completed in the evacuation and stopper insertion units 35, the vacuum plungers 42 are slid in the direction of the bottle heads, wherein they press the closure stoppers 2 into the bottles 1. In the course of this, the conveyor device 13 on which the bottles 1 are disposed constitutes a buttress for the vacuum plungers 42. When the closing of the bottles 1 by means of the closure stoppers 2 is finished as well, the bottleneck seals 39 are deactivated so that the bottles 1 are released in the receiving openings 38, whereupon the evacuation and stopper insertion module 25 is then moved upward out of the region of the first conveyor device 13 (FIG. 6). For the evacuation and closure of the subsequent bottles 1 delivered on the conveyor device 13, the procedures are repeated as described above.

If a cleaning or sterilizing of the evacuation and stopper insertion units 35 is required, the evacuation and stopper insertion module 25 is moved in coincidence with the sterilization plate 32. This is carried out by means of the control unit of the device 10, which correspondingly controls the drive mechanisms of the carrier rails 28, 29, 30. As soon as the evacuation and stopper insertion units 35 are lowered in a sealed fashion onto the washing plate 32 and are secured by means of locking devices, not shown, the membrane valves 47 introduce the cleaning or sterilizing agent into the housing 37, which in particular cleans or sterilizes the freed bottleneck seals 39 and vacuum plungers 42. The cleaning or sterilizing agent can be drained via the drain line 36.

It is additionally mentioned that a transmitter is advantageously disposed on the conveyor section of the conveyor device 13 and when a bottle 1 is not present between two catches 14 of the conveyor device 13, this transmitter sends a corresponding signal to the control unit of the device 10. This results in the fact that the evacuation and stopper insertion unit 35 that would be associated with the bottle 1 if it were present is not triggered and that also as a result, a closure stopper 2 is not removed from the conveyor belt 17.

The foregoing relates to preferred exemplary embodiments of the invention, it being understood that other variants and embodiments thereof are possible within the spirit and scope of the invention, the latter being defined by the appended claims.

What is claimed is:

1. An evacuation and closure device (10), said device is disposed on a first conveyor device (13) that delivers containers (1) in a row, a second conveyor device (17) for delivering closure stoppers (2), a closure stopper and evacuation unit (35) for each container (1), said closure stopper and evacuation unit (35) transfers a closure stopper (2) from said second conveyor device (17) and places the closure stopper (2) on the container (1), a number of closure stoppers and evacuation units (35) are combined into a closure stopper and evacuation module (25) which is connected to one of three carrier elements (28, 29, 30) in relation to one another, and that the closure stopper and evacuation module (25) is movable in three movement axes (X, Y, Z) that are disposed perpendicular to one another by means of freely programmable drive mechanisms.

2. An evacuation and closure device according to claim 1, in which a stationary sterilizing and cleaning device (32) is provided for the closure stopper and evacuation module (25) and that the sterilizing and cleaning device (32) is disposed outside the first and second conveyor devices (13, 17).

3. An evacuation and closure device according to claim 2, in which the sterilizing and cleaning device (32) is disposed together with the closure stopper and evacuation module (25) on a common frame (24).

4. An evacuation and closure device according to claim 1, in which each closure stopper and evacuation unit (35) has a pressure absorber (45), which is coupled to a control unit.

5. An evacuation and closure device according to claim 2, in which each closure stopper and evacuation unit (35) has a pressure absorber (45), which is coupled to a control unit.

6. An evacuation and closure device according to claim 3, in which each closure stopper and evacuation unit (35) has a pressure absorber (45), which is coupled to a control unit.

7. An evacuation and closure device according to claim 1, in which an evacuation and closure device (10) is docked to the first conveyor device (13).

8. An evacuation and closure device according to claim 2, in which an evacuation and closure device (10) is docked to the first conveyor device (13).

9. An evacuation and closure device according to claim 3, in which an evacuation and closure device (10) is docked to the first conveyor device (13).

10. An evacuation and closure device according to claim 4, in which an evacuation and closure device (10) is docked to the first conveyor device (13).

* * * * *